US009395694B1

(12) United States Patent
Wong

(10) Patent No.: US 9,395,694 B1
(45) Date of Patent: Jul. 19, 2016

(54) TIMEPIECE WITH ROTARY BEZEL

(71) Applicant: SEIKO EPSON CORPORATION, Tokyo (JP)

(72) Inventor: Choi hung Wong, Hong Kong (CN)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/040,647

(22) Filed: Feb. 10, 2016

(30) Foreign Application Priority Data

Feb. 26, 2015 (CN) ..... 2015 1 0088082

(51) Int. Cl.
*G04B 19/28* (2006.01)

(52) U.S. Cl.
CPC ..... *G04B 19/286* (2013.01)

(58) Field of Classification Search
CPC ..... G04B 19/28; G04B 19/283; G04B 19/286
See application file for complete search history.

(56) References Cited

U.S. PATENT DOCUMENTS

| | | | | |
|---|---|---|---|---|
| 4,420,264 | A * | 12/1983 | Murata | G04B 19/283 116/279 |
| 5,319,617 | A * | 6/1994 | Sonoda | G04B 19/283 368/294 |
| 6,821,014 | B2 * | 11/2004 | Hiranuma | G04B 19/283 368/294 |
| 2003/0099165 | A1 * | 5/2003 | Terasawa | G04B 19/283 368/294 |
| 2006/0114753 | A1 * | 6/2006 | Gerber | G04B 19/283 368/295 |

FOREIGN PATENT DOCUMENTS

JP 2009-186279 A 8/2009

* cited by examiner

*Primary Examiner* — Vit W Miska
(74) *Attorney, Agent, or Firm* — Global IP Counselors, LLP

(57) ABSTRACT

A timepiece with a rotary bezel includes a rotary bezel attached to a case body so as to be rotatable relative thereto and a spring member disposed between the case body and the rotary bezel. The rotary bezel includes clicking engagement sections and locking engagement sections provided along the direction in which the rotary bezel is rotated and is configured to be movable relative to the case body in a timepiece thickness direction, and the spring member includes an urging piece that urges the rotary bezel toward a timepiece front side.

5 Claims, 16 Drawing Sheets

TIMEPIECE WITH ROTARY BEZEL

BACKGROUND

1. Technical Field

The present invention relates to a timepiece with a rotary bezel.

2. Related Art

As a timepiece having a rotary bezel, such as a diver's watch and a sports watch, there has, for example, been a known timepiece apparatus described in JP-A-2009-186279.

The timepiece apparatus described in JP-A-2009-186279 includes a case body, an annular rotary bezel, and a click member that is supported by the case bezel and engages with and disengages from the rotary bezel. Indices corresponding to the indication hands of the timepiece and other markings are displayed on the front surface of the bezel, and setting a relationship between the indication hands and the indices allows predetermined information to be obtained. Clicking grooves are provided in the rear surface of the rotary bezel along the direction in which the rotary bezel rotates, and a clicking member made of an elastic material is placed in a placement groove that is a groove formed in the case body and faces the clicking grooves.

In the timepiece apparatus described above, when the rotary bezel is rotated against elastic force produced by the clicking member, the engagement between a clicking groove of the rotary bezel and the clicking member is released, and the rotary bezel is allowed to rotate. During the rotation of the rotary bezel, a clicking sensation is provided when a recessed portion of each of the clicking grooves passes over the tip of the click member.

In the timepiece with a rotary bezel of the related art, however, when operational force in the direction of rotation of the rotary bezel acts thereon, the engagement between a clicking groove and the clicking member is released and the rotary bezel rotates. When the rotary bezel unexpectedly rotates, a relationship between the indices displayed on the front surface of the rotary bezel and the indication hands cannot be appropriately maintained, and correct information cannot undesirably be obtained.

SUMMARY

An advantage of some aspects of the invention is to provide a timepiece with a rotary bezel capable of reliably preventing rotation of the rotary bezel when the rotary bezel is not operated.

A timepiece with a rotary bezel according to an aspect of the invention includes a case body, an annular rotary bezel attached to the case body so as to be rotatable relative thereto, and an annular spring member attached to the case body and disposed between the case body and the rotary bezel. The rotary bezel includes clicking engagement sections and locking engagement sections provided along the direction in which the rotary bezel is rotated and is attached to the case body so as to be movable relative thereto in a timepiece thickness direction, and the spring member includes an urging piece that urges the rotary bezel toward a timepiece front side, a clicking piece that engages with and disengages from any of the clicking engagement sections when the rotary bezel is rotated, and a locking piece that engages with any of the locking engagements section when the rotary bezel is moved toward the timepiece front side to prevent the rotary bezel from rotating, whereas disengaging from the locking engagement section when the rotary bezel is moved toward a timepiece rear side to allow the rotary bezel to rotate.

According to the aspect of the invention, when the rotary bezel is not operated, the rotary bezel is urged by the urging piece of the spring member and located in a locking position on the timepiece front side, and the locking piece of the spring member engages with any of the locking engagement sections of the rotary bezel to prevent the rotary bezel from rotating. In contrast, when the rotary bezel is operated, the rotary bezel is moved against urging force produced by the urging piece toward the timepiece rear side. The rotary bezel thus moves to an unlocking position, and the engagement between the locking engagement section of the rotary bezel and the locking piece of the spring member is released, whereby the rotary bezel is allowed to rotate. When an operator stops rotating the rotary bezel, the urging force causes the rotary bezel to return to the locking position, and the locking piece engages with any of the locking engagement sections. The locked state is thus achieved again. The rotary bezel is therefore reliably not allowed to rotate when it is not operated.

When the rotary bezel is rotated, a state in which the clicking piece engages with any of the clicking engagement sections and a state in which the engagement is released alternately occur. The operator of the rotary bezel therefore feels a clicking sensation, whereby the operability of the rotary bezel is improved.

When the operator stops rotating the rotary bezel, the clicking piece engages with any of the clicking engagement sections. Configuring the locking engagement sections and the clicking engagement sections in such a way that the numbers thereof and the positional relationship therebetween correspond to each other allows the locking piece to engage with any of the locking engagement sections and prevents the rotary bezel from rotating when the rotary bezel with the clicking piece engaging with any of the clicking engagement sections is urged toward the timepiece front side and moves to the locking position. That is, during the movement of the rotary bezel from the unlocking position back to the locking position, no positional shift of the rotary bezel in the direction of rotation occurs, whereby a content displayed on the rotary bezel located in the position where the operator stops rotating the rotary bezel can be reliably maintained.

In the timepiece with a rotary bezel according to the aspect of the invention, the rotary bezel may include a bezel body provided with the clicking engagement sections and an annular fixed member fixed to the bezel body and provided with the locking engagement sections.

According to the aspect of the invention with this configuration, since the fixed member, which is a member separate from the bezel body, is provided with a plurality of locking engagement sections, and the fixed member is fixed to the bezel body, the bezel body does not need to be directly provided with the locking engagement sections, whereby the shape of the bezel body can be simplified and the bezel body can therefore be readily manufactured.

In the timepiece with a rotary bezel according to the aspect of the invention, the rotary bezel may include a bezel body and an annular fixed member fixed to the bezel body and provided with the clicking engagement sections and the locking engagement sections.

According to the aspect of the invention with this configuration, since the fixed member is provided with the clicking engagement sections as well as the locking engagement sections, the bezel body does not need to be directly provided with the clicking engagement sections or the locking engagement sections, whereby the shape of the bezel body can be further simplified and the bezel body can therefore be further readily manufactured.

A timepiece with a rotary bezel according to another aspect of the invention includes a case body, an annular rotary bezel attached to the case body so as to be rotatable relative thereto, and an annular spring member attached to the case body and disposed between the case body and the rotary bezel. The rotary bezel includes engagement sections provided along the direction in which the rotary bezel is rotated and is attached to the case body so as to be movable relative thereto in a timepiece thickness direction. The spring member includes a first spring member fixed to the case body and a second spring member disposed between the first spring member and the rotary bezel and movable in the timepiece thickness direction. The first spring member includes an urging piece that urges the second spring member toward a timepiece front side and a locking piece that engages with any of the engagement sections when the rotary bezel is moved toward the timepiece front side to prevent the rotary bezel from rotating in one direction, whereas disengaging from the engagement section when the rotary bezel is moved toward a timepiece rear side to allow the rotary bezel to rotate in the one direction, and the second spring member includes a clicking piece that engages with and disengages from any of the engagement sections when the rotary bezel is rotated so that the clicking piece that engages with the engagement section prevents the rotary bezel from rotating in another direction.

According to the aspect of the invention, the locking piece of the first spring member and the clicking piece of the second spring member engage with and disengage from the common engagement sections of the rotary bezel. In the aspect of the invention, when the rotary bezel is not operated, the clicking piece that engages with any of the engagement sections prevents the rotary bezel from rotating in the other direction. The locking piece therefore only needs to have a shape that prevents the rotary bezel from rotating in the one direction when the locking piece engages with any of the engagement sections, whereby the shape of the locking piece can be simplified. Further, the rotary bezel in the aspect of the invention only needs to be provided with common engagement sections with which the clicking piece and the locking piece engage and from which they disengage. The thus configured engagement sections have the same structure as the structure of the engagement sections provided in a timepiece with a rotary bezel of related art, whereby an existing rotary bezel can be used as it is.

In the timepiece with a rotary bezel according to the aspect of the invention, the second spring member is preferably provided with a pressing section that presses the locking piece when the rotary bezel is moved toward the timepiece rear side to cause the locking piece to disengage from the engagement sections.

According to the aspect of the invention with this configuration, when the rotary bezel is operated, the locking piece can be reliably pressed via the pressing section and is allowed to disengage from the engagement section to unlock the rotary bezel.

Any of the aspects of the invention can provide a timepiece with a rotary bezel capable of reliably preventing rotation of the rotary bezel when the rotary bezel is not operated.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
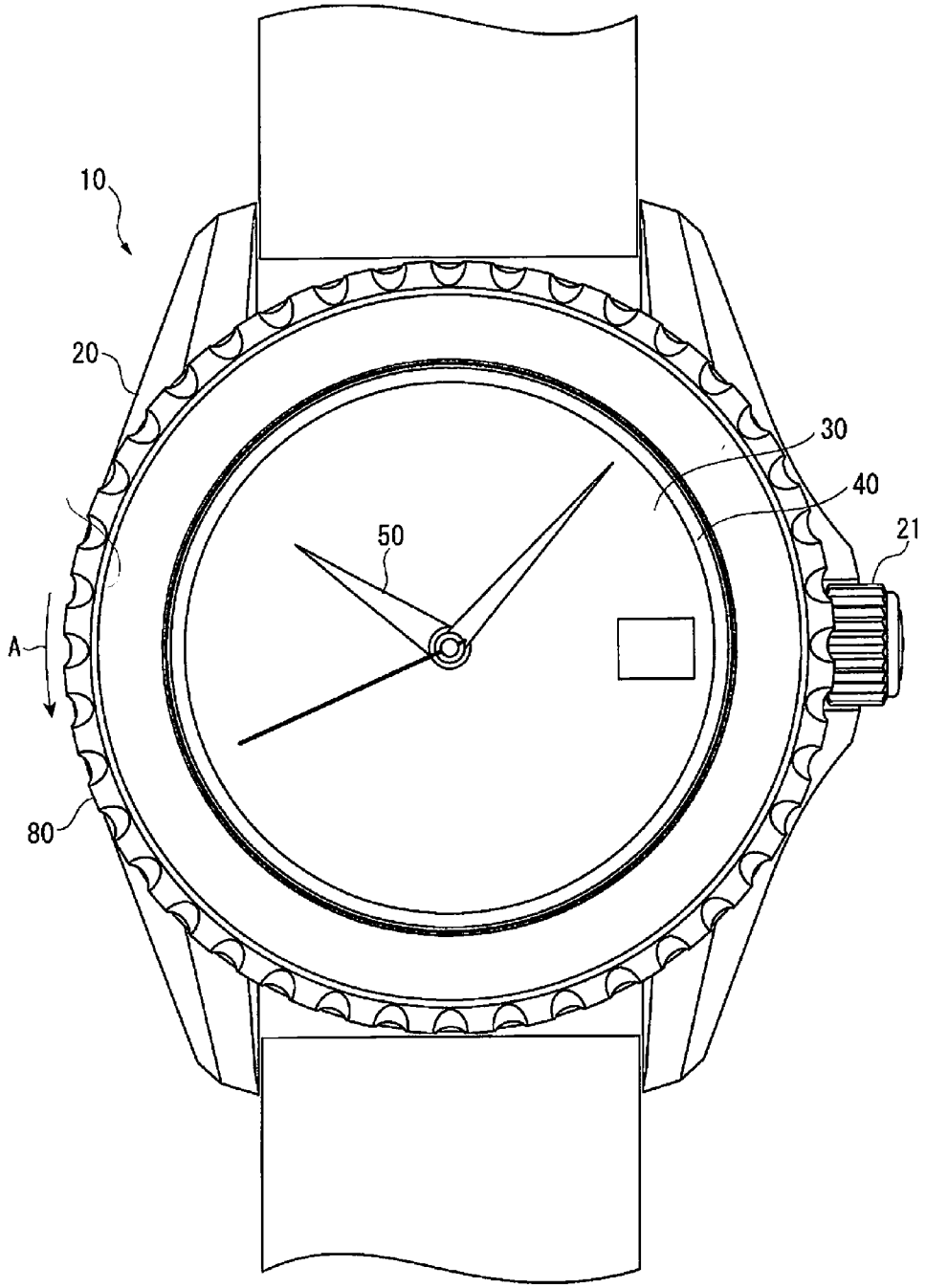
FIG. 1 is a plan view showing a timepiece with a rotary bezel according to a first embodiment of the invention.

A timepiece with a rotary bezel 10 according to a first embodiment of the invention will be described below with reference to the drawings. In second and third embodiments, which will be described later, the same members as those in the first embodiment, which will be described below, and members having the same functions as those of members in the first embodiment have the same reference characters, and descriptions of these members will be omitted or simplified.

Figure 2:
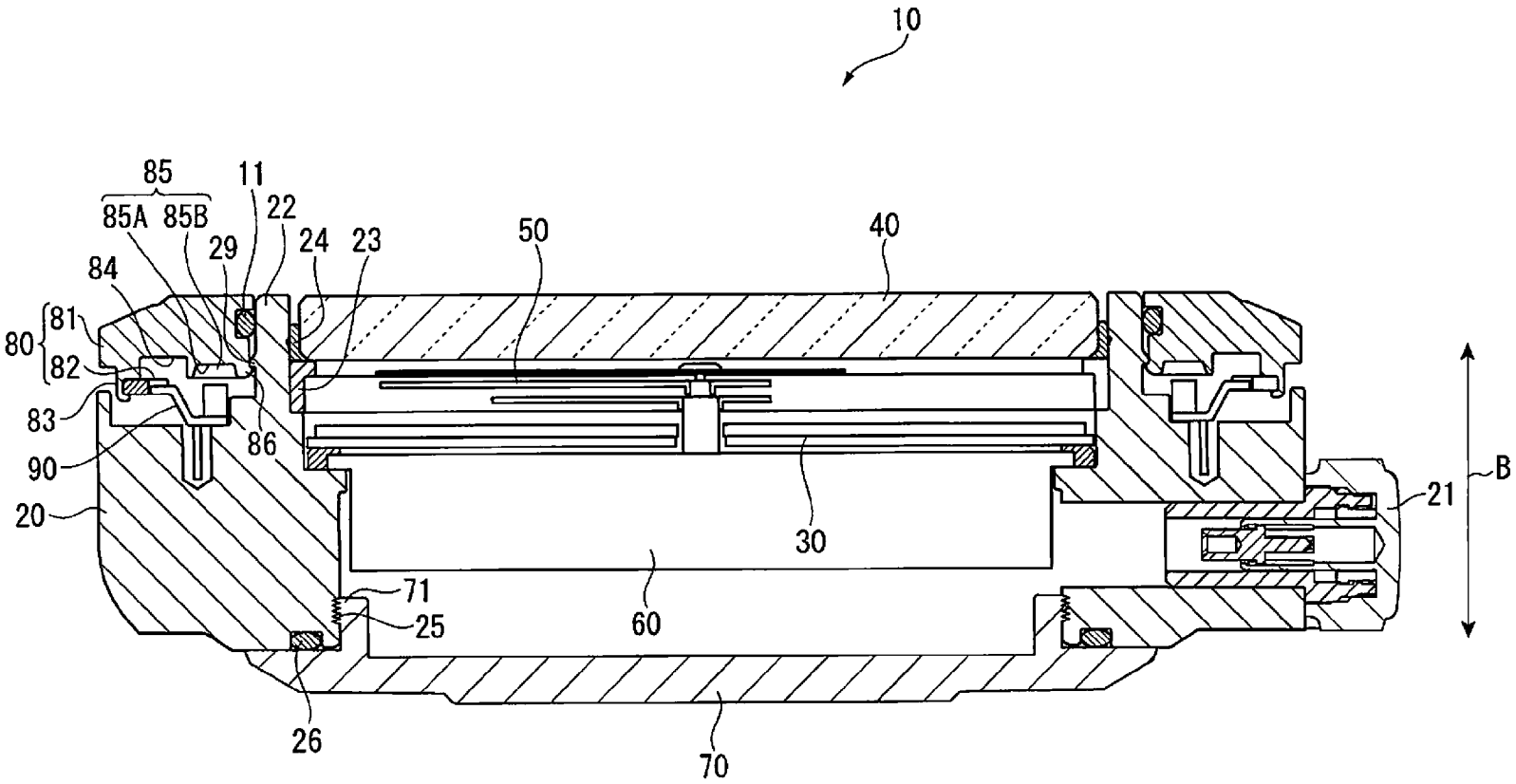
FIG. 2 is a cross-sectional view showing an internal structure of the timepiece with a rotary bezel according to the first embodiment.
Figure 3:
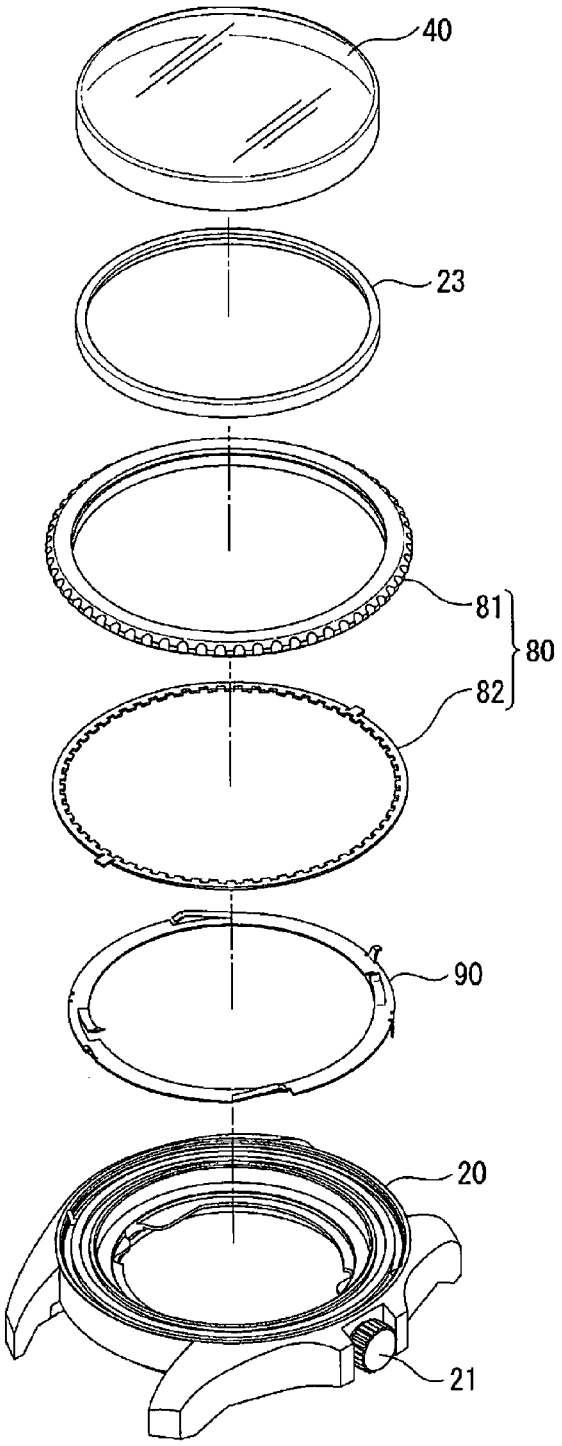
FIG. 3 is an exploded perspective view showing exterior parts that form the timepiece with a rotary bezel according to the first embodiment.

FIG. 1 is a plan view showing the timepiece with a rotary bezel 10 according to the present embodiment. FIG. 2 is a cross-sectional view showing an internal structure of the timepiece with a rotary bezel 10. FIG. 3 is an exploded perspective view showing exterior parts that form the timepiece with a rotary bezel 10.

Schematic Configuration of Timepiece with a Rotary Bezel

In FIGS. 1 to 3, the timepiece with a rotary bezel 10 includes a case body 20, which is made of a metal and has a flat cylindrical shape, a dial 30, which is disposed in the case body 20, a cover glass plate 40, which covers the dial 30, indication hands 50, which include a second hand, a minute hand, and an hour hand and are disposed between the dial 30 and the cover glass plate 40, a movement 60 (see FIG. 2), which is accommodated in the case body 20 and drives the indication hands 50, and a case back 70, which covers an opening on a timepiece rear side of the case body 20.

A crown 21 for adjusting and setting the movement 60 and the indication hands 50 is disposed on the side surface of the case body 20. Buttons may be disposed in adjacent to the crown 21.

The dial 30 and the indication hands 50 are configured to be capable of displaying time and visually recognized through the cover glass plate 40 from a timepiece front side.

The cover glass plate 40 is made, for example, of sapphire glass and held in a tubular glass rim 22, which is part of the case body 20 and formed on the timepiece front side, via an annular parting member 23 and an annular plastic gasket 24.

The movement 60 includes a stepper motor and a wheel train that drive the indication hands 50 and further includes a control circuit board that controls the driving operation of the stepper motor.

The case back 70 has a male threaded portion 71. The male threaded portion 71 is screwed into a female threaded portion 25 engraved in the case body 20. The case back 70 is therefore detachably attached to the case body 20 via a waterproof gasket 26.

Rotary Bezel

The timepiece with a rotary bezel 10 according to the present embodiment includes a rotary bezel 80 as well as the case body 20, the cover glass plate 40, and the case back 70 described above as exterior parts.

The rotary bezel 80 is made of a metal, ceramic, or plastic material, has an annular shape, and is disposed along the outer circumference of the glass rim 22 of the case body 20, as shown in FIGS. 1 to 3. The rotary bezel 80 is further provided so as to be rotatable relative to the case body 20 and movable in a timepiece thickness direction. That is, the rotary bezel 80 is rotatable in the direction of rotation indicated by the arrow A in FIG. 1 and movable in the timepiece thickness direction indicated by the arrow B in FIG. 2. In FIG. 2, the upper side is the timepiece front side, and the lower side is the timepiece rear side. The thus configured rotary bezel 80 includes an annular bezel body 81, which is fit around the outer circumference of the glass rim 22 via a waterproof gasket 11, and an annular fixed member 82, which is fixed to the bezel body 81.

The rear surface of the bezel body 81 is provided with a fixing section 83, which extends toward the case body 20, continuously in the circumferential direction of the bezel body 81. The fixed member 82 is fixed to the inner circumference of the fixing section 83, for example, in a caulking process.

A clearance groove 84, which recedes toward the timepiece front side, is provided in the rear surface of the bezel body 81 continuously in the circumferential direction and inside the fixing section 83 in the radial direction. Groove-shaped clicking engagement sections 85, which have a plurality of (60, for example) recesses 85A arranged at equal intervals in the circumferential direction, are provided further inside the clearance groove 84 of the bezel body 81. A portion between adjacent recesses 85A protrudes from the recesses 85A toward the timepiece rear side. The protruding portions are shown in the drawing as protrusions 85B in the present embodiment. The inner circumferential surface of the bezel body 81 is provided with a bezel-side locking section 86, which protrudes toward the glass rim 22, which faces the inner circumferential surface in the radial direction.

Fixed Member

Figure 4:
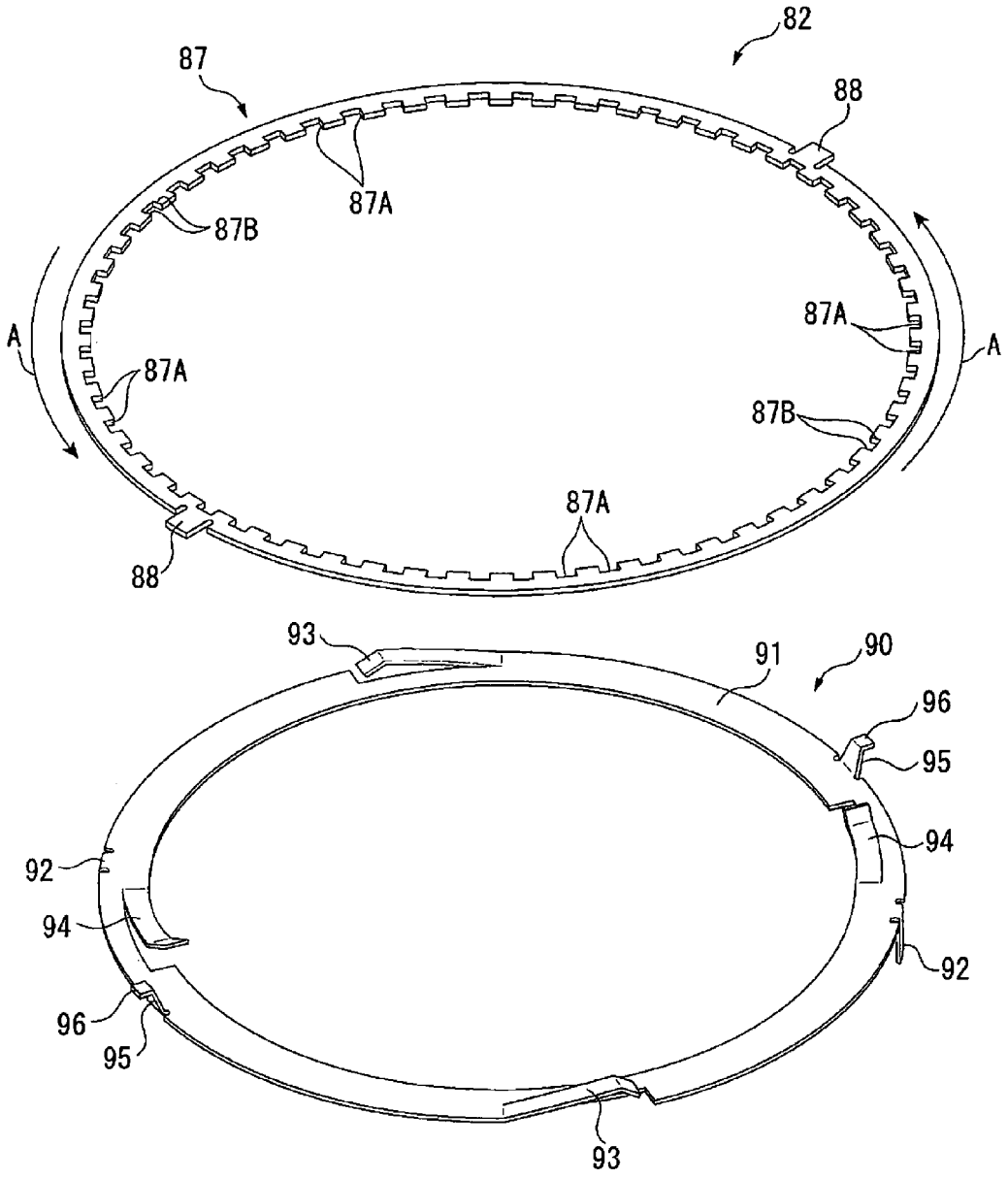
FIG. 4 is an enlarged perspective view showing a fixed member and a spring member of the timepiece with a rotary bezel according to the first embodiment.

FIG. 4 is an enlarged perspective view of the fixed member 82 and a spring member 90, the latter of which will be described above.

In FIGS. 1 to 4, a plurality of (60, for example) cutout openings 87A, each of which is a rectangular cutout that opens outward in the radial direction, are provided at equal intervals along the inner circumference of the fixed member 82. The cutout openings 87A form locking engagement sections 87, which are arranged along the circumferential direction of the fixed member 82. The fixed member 82 is provided with a pair of fixing pieces 88, which protrude outward. The fixing pieces 88 are caulked along with the fixing section 83 of the bezel body 81, and the fixed member 82 is thus fixed to the bezel body 81. Although not shown in detail, among the front-side side edges of the cutout openings 87A, which form the locking engagement sections 87, side edges 87B located on the upstream and downstream sides in the direction of rotation are chamfered so as to allow smooth engagement and disengagement between the fixed member 82 and locking pieces 95 of the spring member 90, which will be described later, whereby the locking pieces 95 are guided by the chamfered side edges and engage with the fixed member 82.

Spring Member

On the other hand, the spring member 90, which is made of a metal spring material, is disposed between the rotary bezel 80 and the case body 20.

The spring member 90 has an annular body section 91 and is placed on a flat placement surface 27 (see FIG. 5), which is a surface of the case body 20 and faces the rear surface of the bezel body 81. The body section 91 is provided with legs 92, which are press-fitted or otherwise inserted into attachment holes 28 provided through the placement surface 27, urging pieces 93, which urge the rotary bezel 80 toward the timepiece front side, clicking pieces 94, which engage with and disengage from the clicking engagement sections 85 when the rotary bezel 80 (bezel body 81) is rotated and allow the rotary bezel 80 to rotate in one direction, and the locking pieces 95, which engage, when the rotary bezel 80 is moved toward the timepiece front side, with the locking engagement sections 87 to prevent rotation of the rotary bezel 80 and disengage, when the rotary bezel 80 is moved toward the timepiece rear side, from the locking engagement sections 87 to allow rotation of the rotary bezel 80.

The legs 92, the urging pieces 93, the clicking pieces 94, and the locking pieces 95 are located along the circumferential direction and in positions different from one another.

The legs 92 are formed of a pair of legs provided in positions symmetrical with respect to the center of the body section 91 in a plan view. The legs 92 are formed by bending extension pieces that extend from the outer circumference of the body section 91 outward in the radial direction. That is, each of the legs 92 is formed by bending the base end thereof in the direction perpendicular to the body section 91 so that the tip of the leg 92 faces the timepiece rear side.

The urging pieces 93 are formed of a pair of urging pieces provided in positions symmetrical with respect to the center of the body section 91 in a plan view. Each of the urging pieces 93 is raised so as to be inclined to the body section 91 and approach the timepiece front side with distance toward the tip of the urging piece 93. The direction from the base end of each of the urging pieces 93 toward the tip thereof coincides with the direction in which the rotary bezel 80 is allowed to rotate (see arrow A). The tip of each of the urging pieces 93 is bent toward the timepiece rear side, and the bent portion comes into contact with the lower surface of the bezel body 81 and can urge the entire rotary bezel 80 toward the timepiece front side without any damage to the lower surface.

The radial position of the urging pieces 93 is shifted outward from the radial position of the clicking pieces 94, and the urging pieces 93 therefore do not come into contact with the clicking engagement sections 85, with which clicking pieces 94 engage.

The clicking pieces 94 are also formed of a pair of clicking pieces provided in positions symmetrical with respect to the center of the body section 91 in a plan view. Each of the clicking pieces 94 is raised so as to be inclined to the body section 91 and approach the timepiece front side with distance toward the tip of the clicking piece 94. The direction from the base end of each of the clicking pieces 94 toward the tip thereof coincides with the direction in which the rotary bezel 80 is allowed to rotate (see arrow A). The tip of each of the clicking pieces 94 is bent so as to face the timepiece front side, in contrast with the urging pieces 93, and the tips are obliquely fit into the clicking engagement sections 85 of the rotary bezel 80.

When the rotary bezel 80 is rotated in one direction indicated by the arrow A, the thus formed clicking pieces 94 are pressed and elastically deformed by the protrusions 85B of the clicking engagement sections 85, disengage from the clicking engagement sections 85, and allow the protrusions 85B to pass in the one direction. The rotary bezel 80 is thus allowed to rotate in the one direction. Further, the tips of the clicking pieces 94 are obliquely fitted in the recesses 85A of the clicking engagement sections 85 except immediately after the clicking pieces 94 pass over the protrusions 85B of the clicking engagement sections 85 and when the rotary bezel 80 is not operated.

Therefore, even when an attempt to rotate the rotary bezel 80 in the other direction is made, the protrusions 85B are caught by the tips of the clicking pieces 94, and the clicking pieces 94 push and oppose the protrusions 85B, preventing rotation of the rotary bezel 80 in the other direction. That is, the clicking engagement sections 85 and the clicking pieces 94 form a ratchet mechanism that allows the rotary bezel 80 to rotate only in the one direction.

Each of the locking pieces 95 is formed by bending an extension piece that extends from the outer circumference of the body section 91 outward in the radial direction. Each of the locking pieces 95 is so formed that the base end thereof is bent by a predetermined angle with respect to the body section 91 and the tip of the locking piece 95 is shifted toward the timepiece front side. Each of the locking pieces 95 as a whole has a roughly trapezoidal shape tapered toward the upper base. The tip of each of the locking pieces 95 is bent outward in the radial direction, and the bent tip portion forms an engagement/disengagement section 96. The locking engagement sections 87 of the fixed member 82 move from the timepiece rear side toward the timepiece front side to engage with the engagement/disengagement sections 96, whereas the locking engagement sections 87 move from the timepiece front side toward the timepiece rear side to disengage from the engagement/disengagement sections 96.

That is, when the rotary bezel 80 is not operated, the rotary bezel 80 is urged by the urging pieces 93 toward the timepiece front side, and the locking engagement sections 87 and the engagement/disengagement sections 96 engage with each other. The position where the state described above is achieved is a locking position of the rotary bezel 80. In the state in which the locking engagement sections 87 and the engagement/disengagement sections 96 engage with each other, the engagement prevents the rotary bezel 80 from rotating in both the one direction and the other direction. On the other hand, when the rotary bezel 80 is pushed toward the timepiece rear side, the locking engagement sections 87 and the engagement/disengagement sections 96 disengage from each other. The position where the state described above is achieved is an unlocking position of the rotary bezel 80.

Further, in the present embodiment, the recesses 85A and the cutout openings 87A are so positioned that the engagement/disengagement sections 96 of the locking pieces 95 are allowed to engage with the cutout openings 87A of the locking engagement sections 87 in each position where the clicking pieces 94 engage with the recesses 85A of the clicking engagement sections 85.

Procedure of Attaching Rotary Bezel

In the timepiece with a rotary bezel 10 described above, the rotary bezel 80 is assembled in advance by attaching fixed member 82 to the bezel body 81, for example, in a caulking process. Further, the spring member 90 is placed in the case body 20 by inserting the legs 92 of the spring member 90 into the attachment holes 28 of the case body 20. The rotary bezel 80 is then placed around the outer circumference of the glass rim 22 and pushed toward the timepiece rear side. The bezel-side locking section 86, which is provided along the inner circumference of the bezel body 81, thus climbs over a case-side locking section 29, which is provided along the outer circumference of the glass rim 22, and the rotary bezel 80 is held in the locking position, where the rotary bezel 80 is urged by the urging pieces 93 of the spring member 90.

Description of State of Rotary Bezel

The state of the rotary bezel 80 in the case where it is not operated and the state of the rotary bezel 80 in the case where it is operated will be described with reference also to FIGS. 5 and 6.

Figure 5:
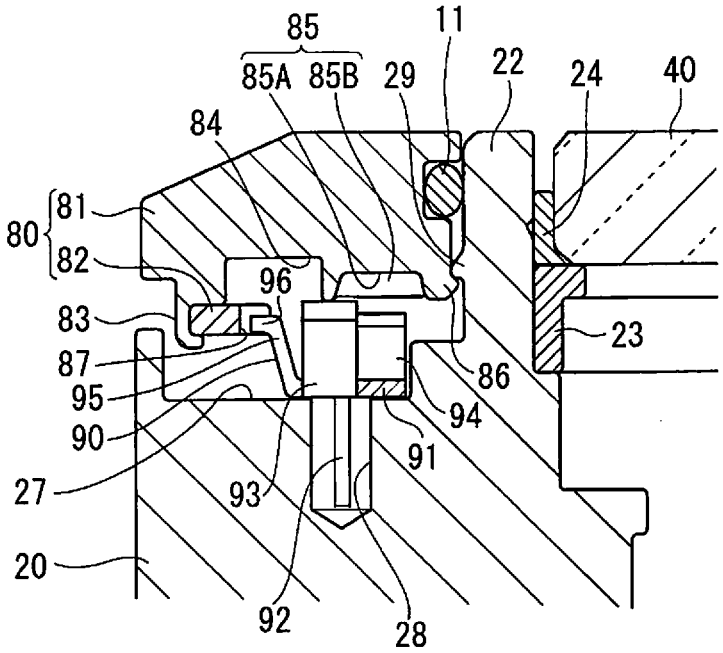
FIG. 5 is an enlarged cross-sectional view showing a state in which the rotary bezel is not rotated in the first embodiment.
Figure 6:
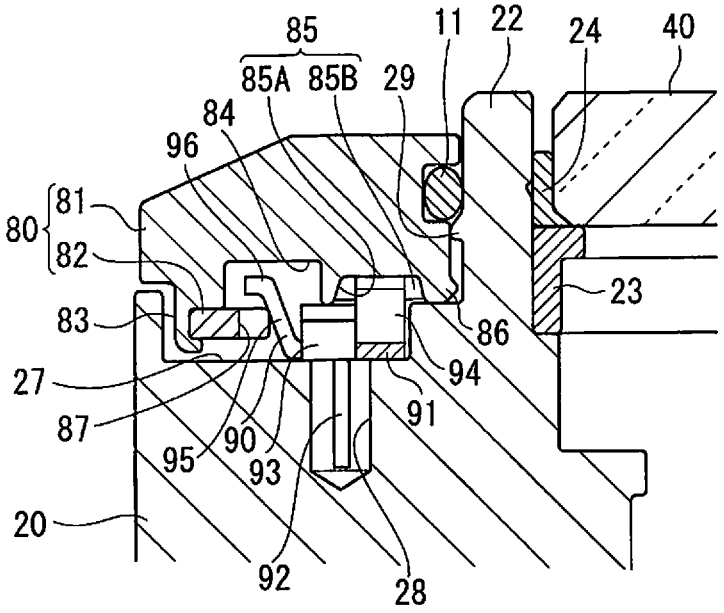
FIG. 6 is an enlarged cross-sectional view showing a state in which the rotary bezel is rotated in the first embodiment.

When the rotary bezel 80 is not operated, urging force produced by the urging pieces 93 of the spring member 90 locates the rotary bezel 80 in the locking position on the timepiece front side, as shown in FIG. 5. In this state, the locking engagement sections 87, which are provided along the fixed member 82 of the rotary bezel 80, and the engagement/disengagement sections 96 of the locking pieces 95 of the spring member 90 engage with each other, and the rotary bezel 80 does not therefore rotate in the one direction or the other direction or is locked. Further, the bezel-side locking section 86 provided around the bezel body 81 is locked with the case-side locking section 29 of the glass rim 22, and the locked state prevents the rotary bezel 80 from disengaging from the case body 20.

In preparation for rotation of the rotary bezel 80, when the rotary bezel 80 is pushed against the urging force produced by the urging pieces 93 of the spring member 90 toward the timepiece rear side, the rotary bezel 80 deforms the urging pieces 93 and moves to the unlocking position. The locking engagement sections 87 then disengage from the engagement/disengagement sections 96, and the engagement/disengagement sections 96 enter the clearance groove 84 in the bezel body 81, as shown in FIG. 6. The movement of the rotary bezel 80 toward the timepiece rear side further causes the clicking pieces 94 of the spring member 90 to engage with the clicking engagement sections 85. The movement of the rotary bezel 80 toward the timepiece rear side is restricted when a circumferential edge that is part of the rotary bezel 80 and located inside the clicking engagement sections 85 comes into contact with a surface that is part of the case body 20 and faces the circumferential edge.

Thereafter, when the rotary bezel 80 is pushed and rotated in the one direction, the rotary bezel 80 slides over the urging pieces 93, and the recesses 85A and the protrusions 85B of the clicking engagement sections 85 pass over the clicking pieces 94 while deforming the clicking pieces 94 and returning them to their initial positions. The rotary bezel 80 thus rotates in the one direction. In this process, whenever the clicking pieces 94 fit into recesses 85A of the clicking engagement sections 85, the clicking pieces 94 elastically return to the pre-deformation shape thereof and hit the inner surfaces of the recesses 85A, providing a clicking sensation in the rotation operation. Further, even when the rotary bezel 80 is pushed so that the locking pieces 95 disengage from the locking engagement sections 87, the ratchet mechanism formed of the clicking engagement sections 85 and the clicking pieces 94 prevents the rotary bezel 80 from rotating in the other direction.

After an operator rotates the rotary bezel 80 to cause the clicking pieces 94 to fit into recesses 85A of the clicking engagement sections 85, and when the operator stops pushing the rotary bezel 80, the rotary bezel 80 returns back to the state before it is rotated. That is, the rotary bezel 80 is urged by the urging pieces 93 and returns to the locking position, the clicking pieces 94 disengage from the clicking engagement sections 85, and the locking pieces 95 engage with the locking engagement sections 87. The rotary bezel 80 is therefore not allowed to rotate in the one direction or the other direction.

Advantageous Effects of Embodiment (1) According to the present embodiment, when the rotary bezel 80 is not operated, the rotary bezel 80 can be held in the locking position. That is, in the locking position, the rotary bezel 80 is urged by the urging pieces 93 of the spring member 90 and engages with the locking pieces 95 of the spring member 90, whereby the rotary bezel 80 is not allowed to rotate.

In contrast, when the rotary bezel 80 is operated, the rotary bezel 80 is moved against the urging force produced by the urging pieces 93 toward the timepiece rear side. The rotary bezel 80 thus moves to the unlocking position, and the engagement between the rotary bezel 80 and the locking pieces 95 of the spring member 90 can be released. In this position, the clicking pieces 94 of the spring member 90 engage with the clicking engagement sections 85 of the rotary bezel 80, whereby the rotary bezel 80 can be rotated in the one direction while the clicking engagement sections 85 and the clicking pieces 94 repeatedly undergo engagement and disengagement.

Further, when the operator stops rotating the rotary bezel 80, the urging pieces 93 can cause the rotary bezel 80 to return to the locking position on the timepiece front side, whereby the rotary bezel 80 can be locked again by the engagement with the locking pieces 95.

The rotary bezel 80 is therefore reliably not allowed to rotate when it is not operated.

(2) When the rotary bezel 80 is rotated, the recesses 85A and the protrusions 85B of the clicking engagement sections 85 alternately pass over the tips of the clicking pieces 94 for a clicking sensation.

Further, at the point of time when the operator stops rotating the rotary bezel 80, the number of locking engagement sections 87 and clicking engagement sections 85 and the positional relationship therebetween achieve the state in which the clicking pieces 94 fit into recesses 85A of the clicking engagement sections 85, and the rotary bezel 80 in this state is urged and moved toward the timepiece front side, whereby the locking pieces 95 are allowed to engage with the locking engagement sections 87 to prevent the rotary bezel 80 from rotating. That is, during the movement of the rotary bezel 80 from the unlocking position to the locking position, there is no concern about a positional shift of the rotary bezel 80 in the direction of rotation, whereby a content displayed on the rotary bezel 80 located in the position where the operator stops rotating the rotary bezel 80 can be reliably maintained.

(3) Further, in the present embodiment, since the fixed member 82, which is a member separate from the bezel body 81, is provided with the plurality of locking engagement sections 87, and the fixed member 82 is fixed to the bezel body 81, the bezel body 81 does not need to be directly provided with the locking engagement sections 87, whereby the shape of the bezel body 81 can be simplified and the bezel body 81 can therefore be readily manufactured.

(4) Since the spring member 90 is provided and integrated with pieces having different functions, such as the urging pieces 93, the clicking pieces 94, and the locking pieces 95, the number of parts can be reduced as compared with a case where these pieces are separately provided, whereby handling of parts and assembly of the parts to the case body 20 can be readily performed.

(5) The rotary bezel 80 is attached by causing the case-side locking section 29 of the case body 20 to lock the bezel-side locking section 86 provided around the bezel body 81. Therefore, when the rotary bezel 80 needs to be exchanged, for example, when the rotary bezel 80 is damaged, the rotary bezel 80 can be readily exchanged by unlocking the bezel-side locking section 86 locked by the case-side locking section 29, whereby after-sales service can be readily performed.

Second Embodiment

Figure 7:
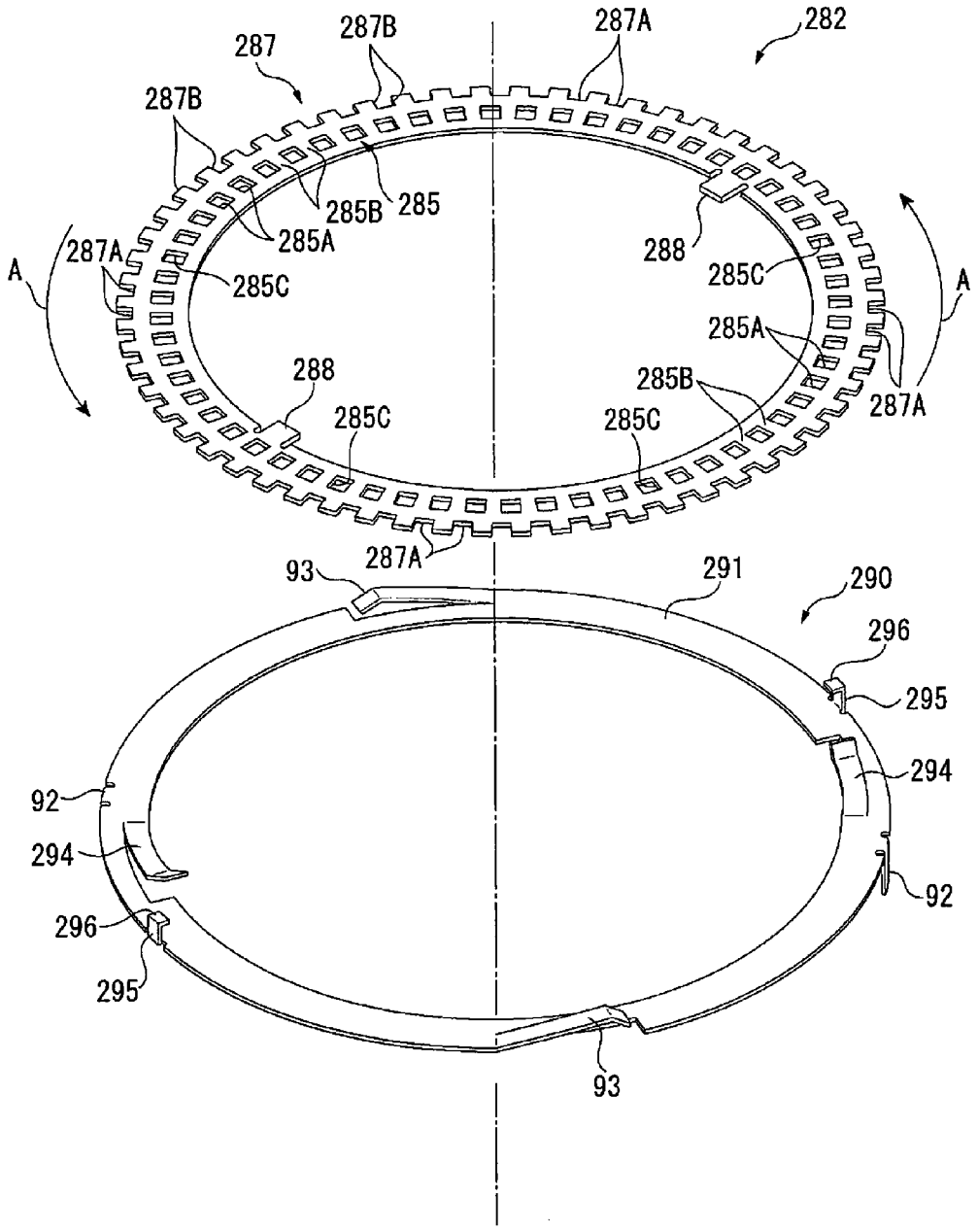
FIG. 7 is a perspective view showing a fixed member and a spring member of a timepiece with a rotary bezel according to a second embodiment of the invention.
Figure 8:
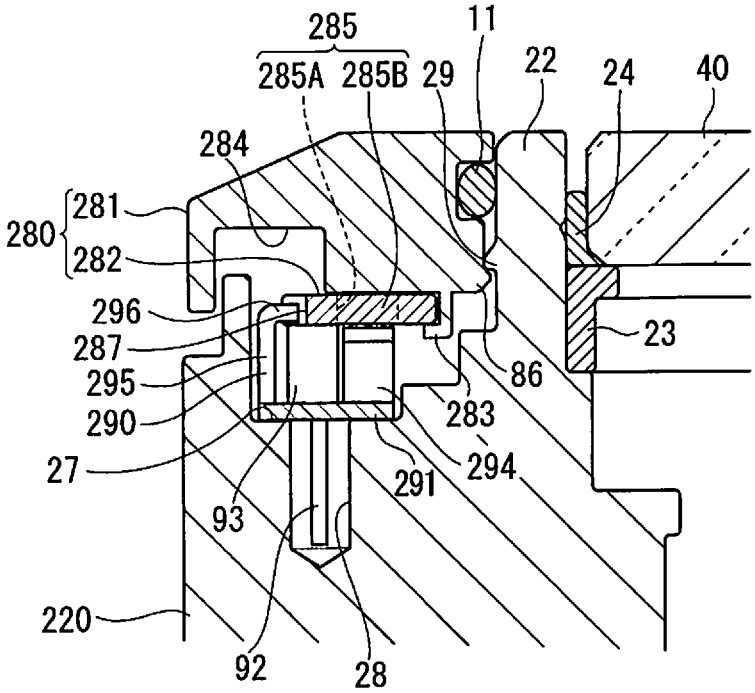
FIG. 8 is an enlarged cross-sectional view showing a state in which the rotary bezel is not rotated in the second embodiment.
Figure 9:
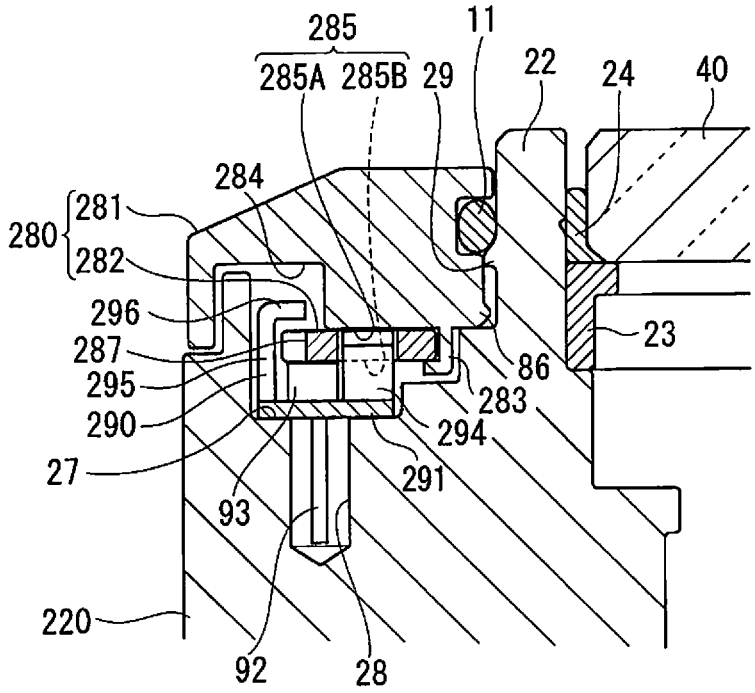
FIG. 9 is an enlarged cross-sectional view showing a state in which the rotary bezel is rotated in the second embodiment.

FIG. 7 is an enlarged perspective view showing a fixed member 282 and a spring member 290 of a timepiece with a rotary bezel according to a second embodiment of the invention. FIG. 8 is an enlarged cross-sectional view showing a state in which a rotary bezel 280 is not operated in the present embodiment. FIG. 9 is an enlarged cross-sectional view showing a state in which the rotary bezel 280 is operated in the present embodiment.

In the present embodiment, the shapes of a bezel body 281 and the fixed member 282, which form the rotary bezel 280, and the shape of the spring member 290 differ from those of the bezel body 81 and the fixed member 82 of the rotary bezel 80 described in the first embodiment.

In FIGS. 7 to 9, a fixing section 283 for fixing the fixed member 282 is provided in a position close to the inner circumference of the bezel body 281, and a clearance groove 284 is provided in a position close to the outer circumference of the bezel body 281. The fixed member 282 is provided with a pair of fixing pieces 288, which extend from the inner circumference of the fixed member 282 inward in the radial direction. Further, the fixed member 282 is provided with locking engagement sections 287 formed of a plurality of cutout openings 287A, which are produced by cutting the fixed member 282 inward from the outer circumference, and clicking engaging sections 285 are provided in positions shifted from the locking engagement sections 287 inward in the radial direction. As the clicking engagement sections 285, a plurality of recesses 285A are formed as rectangular openings that pass through the fixed member 282 from the front surface to the rear surface, and each protrusion 285B is formed as a plate-shaped portion present between an upstream recess 285A and a downstream recess 285A.

In the thus configured fixed member 282, although not shown in detail, among the timepiece-front-side side edges of the cutout openings 287A, which are formed as rectangular cutouts, side edges 287B located on the upstream and downstream sides in the direction of rotation are chamfered so as to allow smooth engagement and disengagement between the fixed member 282 and locking pieces 295 of the spring member 290, whereby the locking pieces 295 is guided by the chamfered side edges and fit in and engage with the fixed member 282. Similarly, among the timepiece-rear-side side edges of the recesses 285A of the clicking engagement sections 285, which are rectangular openings, side edges 285C located on the upstream and downstream sides in the direction of rotation are chamfered so as to allow smooth engagement and disengagement between the fixed member 82 and clicking pieces 294 of the spring member 290.

As for the spring member 290 of the present embodiment, which is attached to a case body 220, each of the locking pieces 295 is formed by bending an extension piece extending from the outer circumference of a body section 291 outward in the radial direction, and each of the locking pieces 295 is further formed by bending the base end thereof in the direction perpendicular to the body section 291 so that the tip of the locking piece 295 faces the timepiece front side. An engagement/disengagement section 296 of each of the locking pieces 295 is formed by bending a front end portion of the locking piece 295 inward in the radial direction. The thus formed engagement/disengagement sections 296 engage with and disengage from the locking engagement sections 287, which are arranged along the outer circumference of the fixed member 282, in the timepiece thickness direction.

In the present embodiment, the movement of the rotary bezel 280 when it is operated and the movement of the rotary bezel 280 when it is not operated are the same as those in the first embodiment, as shown in FIGS. 8 and 9. That is, in FIG. 8, the rotary bezel 280 is located in the locking position. In this position, the engagement/disengagement sections 296 of the locking pieces 295 engage with cutout openings 287A of the locking engagement sections 287, and the rotary bezel 280 is therefore not allowed to rotate in one direction or the other direction. In FIG. 9, the rotary bezel 280 is located in the unlocking position. In this position, the engagement/disengagement sections 296 of the locking pieces 295 disengage from the cutout openings 287A of the locking engagement sections 287, and the rotary bezel 280 is therefore allowed to rotate in the one direction. The procedure of attaching the rotary bezel 280 is the same as that in the first embodiment and will not be described.

According to the present embodiment, the advantageous effects (1), (2), (4), and (5) described in the first embodiment can be similarly provided, and the specific configuration of the present embodiment provides the following advantageous effect.

(6) That is, according to the present embodiment, since the fixed member 282 is provided with the clicking engagement sections 285 as well as the locking engagement sections 287, the bezel body 281 does not need to be directly provided with the clicking engagement sections 285, whereby the shape of the bezel body 281 can be further simplified and the bezel body 281 can therefore be further readily manufactured.

Third Embodiment

Figure 10:
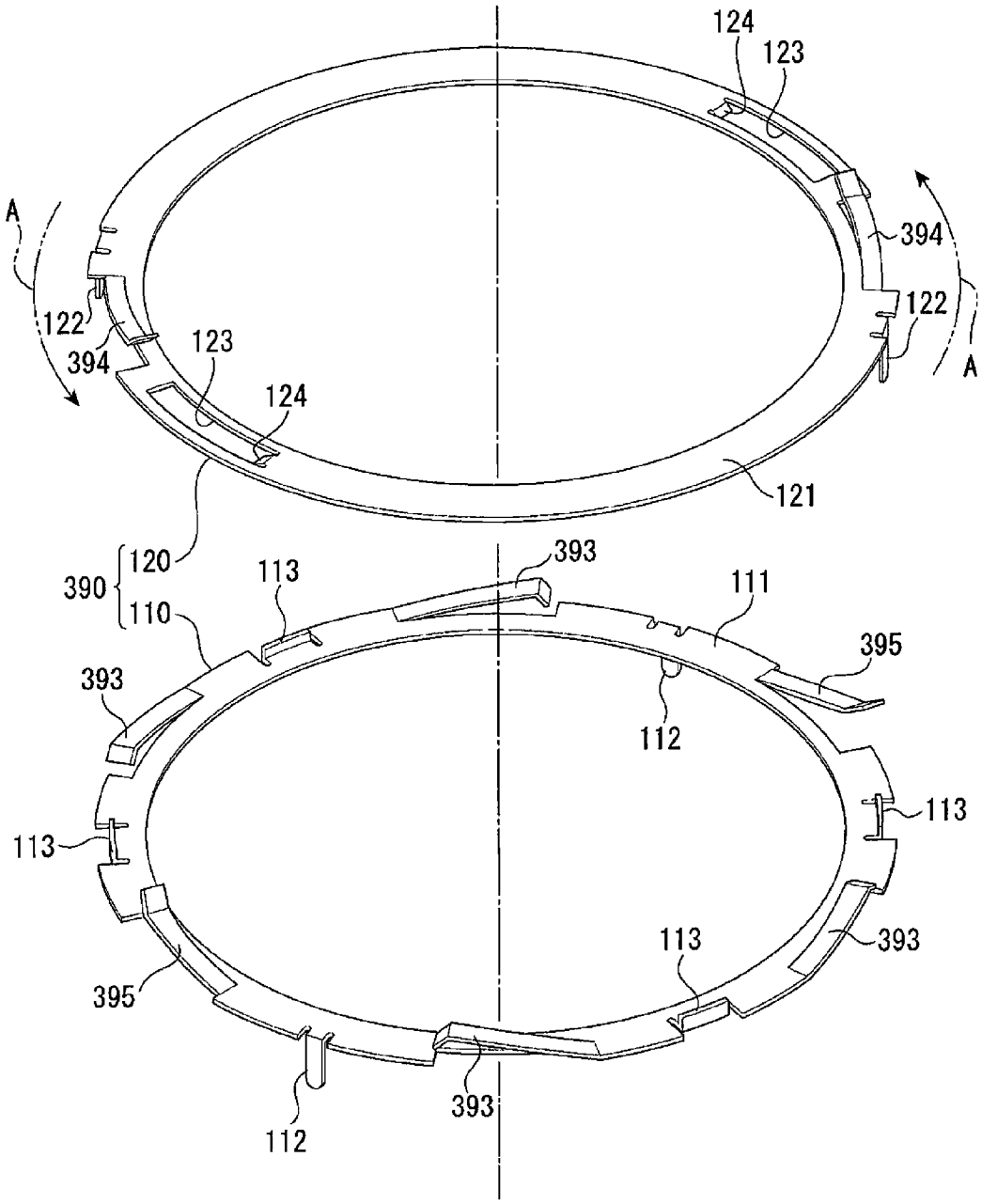
FIG. 10 is a perspective view showing a spring member of a timepiece with a rotary bezel according to a third embodiment of the invention.
Figure 11:
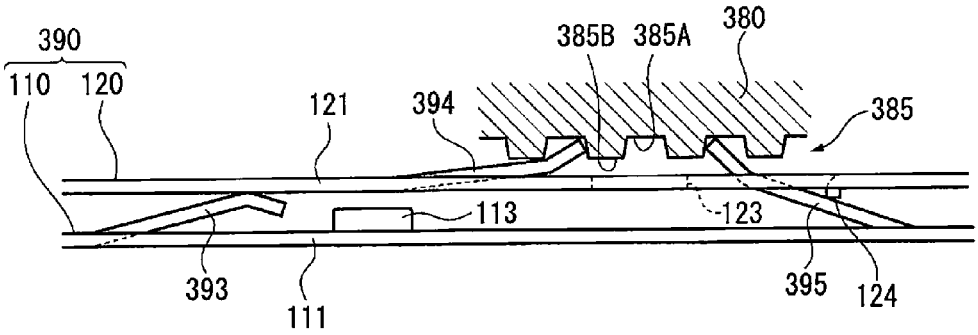
FIG. 11 is an enlarged cross-sectional view showing a state in which the rotary bezel is not rotated in the third embodiment.
Figure 12:
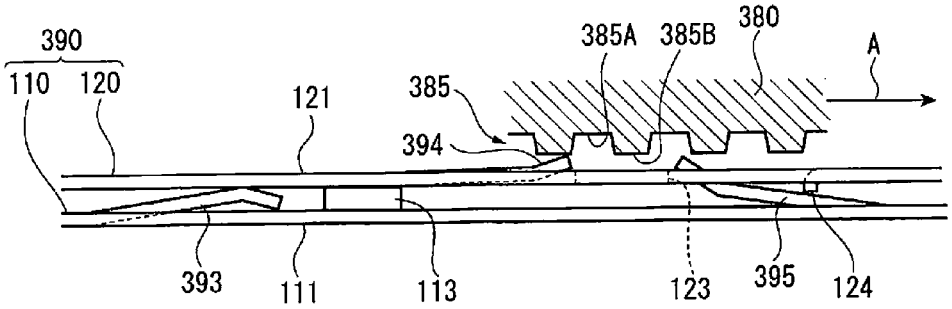
FIG. 12 is an enlarged cross-sectional view showing a state in which the rotary bezel is rotated in the third embodiment.
Figure 13:
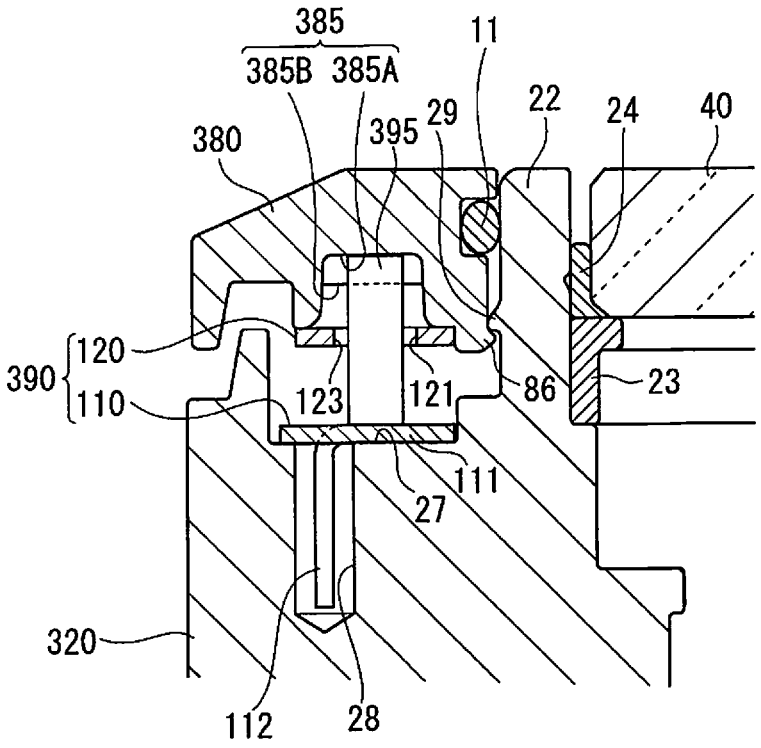
FIG. 13 is an enlarged cross-sectional view taken in another cross-section position and showing the state in which the rotary bezel is not rotated in the third embodiment.
Figure 14:
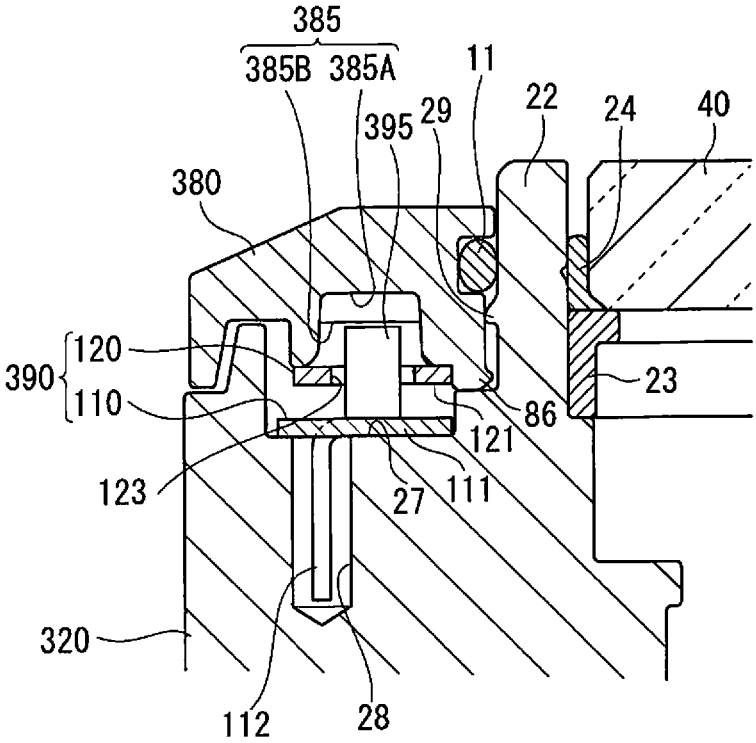
FIG. 14 is an enlarged cross-sectional view taken in the another cross-section position and showing the state in which rotary bezel is rotated in the third embodiment.
Figure 15:
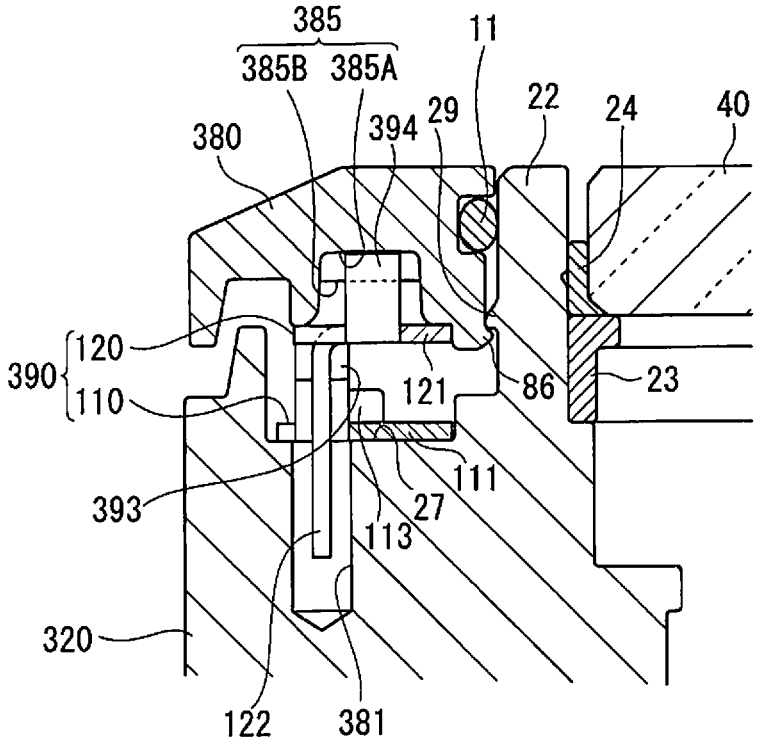
FIG. 15 is an enlarged cross-sectional view taken in still another cross-section position and showing the state in which the rotary bezel is not rotated in the third embodiment.
Figure 16:
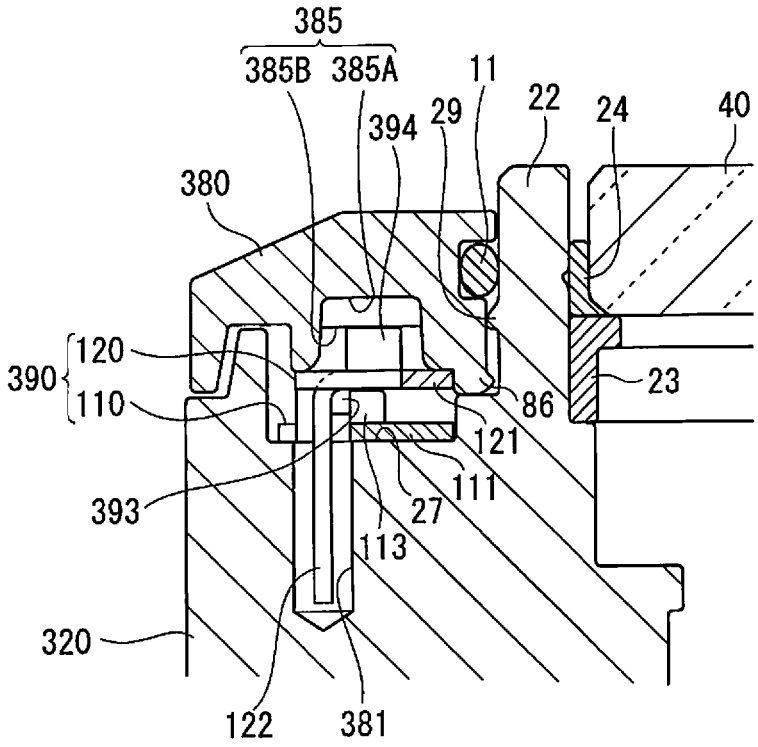
FIG. 16 is an enlarged cross-sectional view taken in the still another cross-section position and showing the state in which the rotary bezel is rotated in the third embodiment.

FIG. 10 is a perspective view showing a spring member 390 of a timepiece with a rotary bezel according to a third embodiment of the invention. FIG. 11 is an enlarged cross-sectional view showing a state in which a rotary bezel 380 is not rotated in the present embodiment. FIG. 12 is an enlarged cross-sectional view showing a state in which the rotary bezel 380 is rotated. FIG. 13 is an enlarged cross-sectional view taken in another cross-section position and showing the state in which the rotary bezel 380 is not rotated. FIG. 14 is an enlarged cross-sectional view taken in the another cross-section position and showing the state in which the rotary bezel 380 is rotated. FIG. 15 is an enlarged cross-sectional view taken in still another cross-section position and showing the state in which the rotary bezel 380 is not rotated. FIG. 16 is an enlarged cross-sectional view taken in the still another cross-section position and showing the state in which the rotary bezel 380 is rotated.

In the present embodiment, the spring member 390 includes a first spring member 110, which is fixed to a case body 320, and a second spring member 120, which is disposed between the first spring member 110 and the rotary bezel 380 and movable in the timepiece thickness direction, as shown in FIGS. 10 to 16.

The rear surface of the rotary bezel 380 is provided with engagement sections 385 having a plurality of recesses 385A and protrusions 385B alternately arranged in the circumferential direction.

The first spring member 110 of the spring member 390 is press-fit or otherwise inserted into the attachment holes 28 of the case body 320 via legs 112 provided on the outer circumferential portion of a body section 111. The first spring member 110 is provided and integrated with urging pieces 393. The urging pieces 393 urge the rotary bezel 380 via the second spring member 120 toward the timepiece front side and keep the second spring member 120 in contact with the rear surface of the rotary bezel 380. The urging pieces 393 are formed of two pairs of urging pieces inclined in different directions, four urging pieces in total, so as to allow stable holding of the rotary bezel 380. The first spring member 110 is further provided and integrated with a pair of locking pieces 395. The locking pieces 395 pass through through openings 123 provided in the second spring member 120, and the tips of the locking pieces 395 engage with and disengage from the engagement sections 385 provided in the rotary bezel 380.

The second spring member 120, which has legs 122 provided on an outer circumferential portion of a body section 121 and removably inserted into insertion holes 318 (see FIGS. 15 and 16) formed through the placement surface 27, is movable in the timepiece thickness direction. The second spring member 120 is provided and integrated with a pair of clicking pieces 394. The clicking pieces 394 engage with and disengage from the engagement sections 385 to form a ratchet mechanism that allows the rotary bezel 380 to rotate in one direction but prevents the rotary bezel 380 from rotating in the other direction.

Each of the locking pieces 395 is raised so as to be inclined to the body section 111 and approach the timepiece front side with distance toward the tip of the locking piece 395. The direction from the base end of each of the locking pieces 395 toward the tip thereof is opposite the direction in which the rotary bezel 380 rotates (see arrow A). The tip of each of the locking pieces 395 is bent toward the timepiece front side, and the tip obliquely fits into the engagement sections 385.

Therefore, in the state in which the locking pieces 395 engage with the engagement sections 385, when an attempt to rotate the rotary bezel 380 in the one direction is made, the protrusions 385B of the engagement sections 385 are caught by the tips of the locking pieces 395, preventing rotation of the rotary bezel 380 in the one direction. On the other hand, the clicking pieces 394 prevent the rotary bezel 380 from rotating in the other direction. That is, in the present embodiment, the clicking pieces 394 and the locking pieces 395 prevent the rotary bezel 380 from rotating in the one direction and the other direction when the rotary bezel 380 is not operated.

Further, in the present embodiment, the engagement sections 385 have both the function of the clicking engagement sections 85, 285 and the function of the locking engagement sections 87, 287 described in the first and second embodiments. Therefore, in the present embodiment, the fixed members 82, 282 provided with the locking engagement sections 87, 287 are not required.

In FIGS. 10 to 12, the body section 111 of the first spring member 110 is provided with stopper pieces 113 at a plurality of (four in the present embodiment) locations in the circumferential direction. Each of the stopper pieces 113 is formed by cutting and raising part of an outer circumferential portion of the body section 111. The thus formed stopper pieces 113 come into contact with the second spring member 120 and restrict the position thereof when the rotary bezel 380 is operated and located in the unlocking position.

That is, when the second spring member 120 is located along with the rotary bezel 380 in the unlocking position, and the rotary bezel 380 is rotated, the protrusions 385B of the engagement sections 385 press and pass over the clicking pieces 394. In this process, if the protrusions 385B press and further moves the entire second spring member 120 toward the timepiece rear side, the clicking pieces 394 do not undergo sufficient elastic deformation. The stopper pieces 113 are therefore caused to come into contact with the second spring member 120 and support it so as to prevent the second spring member 120 from further moving and allow the clicking pieces 394 to undergo sufficient elastic deformation for a satisfactory clicking sensation.

A pressing section 124, which extends toward the first spring member 110, is provided at one edge of each of the through holes 123 provided in the body section 121 of the second spring member 120, the edge on the side facing the tip of the locking piece 395 that passes through the through hole 123. The pressing sections 124 press the locking pieces 395 when the rotary bezel 380 is moved in the timepiece thickness direction to cause the locking pieces 395 to disengage from the engagement sections 385. Each of the pressing sections 124 is configured to press the corresponding locking piece 395 in a portion shifted from the center thereof toward the base end thereof in the direction in which the locking piece extends. When the second spring member 120 is pressed along with the rotary bezel 380 toward the timepiece rear side, the movement of the second spring member 120 greatly deforms the locking pieces 395, whereby the locking pieces 395 reliably disengage from the engagement sections 385.

In the embodiment described above, the first spring member 110 is placed in the case body 320, and the second spring member 120 is placed so as to be overlaid on the first spring member 110. The rotary bezel 380 is then placed around the outer circumference of the glass rim 22 and pressed toward the timepiece rear side. The bezel-side locking section 86 of the rotary bezel 380 thus climbs over the case-side locking section 29 of the glass rim 22. As a result, the rotary bezel 380 is urged by the urging pieces 393 of the first spring member 110 via the second spring member 120 and held in the locking position in the urged state.

The state in which the rotary bezel 380 is not operated and the state in which the rotary bezel 380 is operated will be described below with reference to FIGS. 11 to 16.

First, when the rotary bezel 380 is not operated, the rotary bezel 380 is urged by urging force produced by the urging pieces 393 of the first spring member 110 toward the timepiece front side via the second spring member 120 and located in the locking position, as shown in FIGS. 11, 13, and 15. In this position, both the locking pieces 395 of the first spring member 110 and the clicking pieces 394 of the second spring member 120 engage with recesses 385A of the engagement sections 385 provided in the rotary bezel 380, so that the rotary bezel 380 is not rotated in the one direction or the other direction or is locked.

Thereafter, in preparation for rotation of the rotary bezel 380, when the rotary bezel 380 is pressed against the urging force produced by the urging pieces 393 toward the timepiece rear side, the rotary bezel 380 deforms the urging pieces 393 and moves toward the timepiece rear side. The second spring member 120 then moves along with the rotary bezel 380, as shown in FIGS. 12, 14, and 16. As a result, the pressing sections 124 of the second spring member 120 press the locking pieces 395, and the locking pieces 395 disengage from the engagement sections 385.

Thereafter, when the rotary bezel 380 is pressed and rotated in the one direction, the recesses 385A and the protrusions 385B of the engagement sections 385 pass over the clicking pieces 394 while repeatedly deforming the clicking pieces 394 and returning them to their initial positions. The rotary bezel 380 thus rotates in the one direction. In this process, whenever the clicking pieces 394 fit into recesses 385A of the engagement sections 385, the clicking pieces 394 elastically return to the pre-deformation shape thereof and hit the inner surfaces of the recesses 385A, providing a clicking sensation in the rotation operation. Further, even when the rotary bezel 380 is pushed so that the locking pieces 395 disengage from the engagement sections 385, the ratchet mechanism formed of the engagement sections 385 and the clicking pieces 394 prevents the rotary bezel 380 from rotating in the other direction.

After an operator rotates the rotary bezel 380 to a desired position, and when the operator stops pushing the rotary bezel 380, the rotary bezel 380 returns back to the locking position before it is rotated. That is, the rotary bezel 380 is urged by the urging pieces 393 and returns toward the timepiece front side, the clicking pieces 394 keep engaging with the engagement sections 385, and the locking pieces 395 also engage with the engagement sections 385. The rotary bezel 380 is therefore not allowed to rotate in the one direction or the other direction.

According to the present embodiment, although the configuration therein differs from those in the first and second embodiments, when the rotary bezel 380 is not operated, both the clicking pieces 394 and the locking pieces 395 engage with the engagement sections 385, preventing the rotary bezel 380 from rotating in the one direction and the other direction, whereby the advantageous effect (1) described above can be similarly provided. Further, the specific configuration of the present embodiment can provide the following advantageous effects.

(7) The spring member 390 is formed of two members, the first spring member 110 and the second spring member 120. In the present embodiment, since any of the fixed members used in the first and second embodiments is not required, the step of fixing the fixed member to the bezel body, for example, in a caulking process can be omitted, whereby the assembly can be more readily performed.

(8) When the rotary bezel 380 is not operated, the clicking pieces 394 having engaged with the engagement sections 385 prevent the rotary bezel 380 from rotating in the other direction. The locking pieces 395 therefore only need to have a shape that prevents the rotary bezel 380 from rotating in the one direction when the locking pieces 395 engage with the engagement sections 385, whereby the shape of the locking pieces 395 can be simplified.

(9) Since the rotary bezel 380 in the present embodiment requires no fixed member provided with locking engagement sections, the rotary bezel used in a timepiece with a rotary bezel of related art can be used as it is, whereby an effort of newly designing the rotary bezel 380 can be omitted.

The invention is not limited to the embodiments described above, and improvements, changes, and other modifications to the extent that they achieve the advantage of the invention fall within the scope of the invention.

For example, in the first and second embodiments described above, the tips of the clicking pieces 94, 294 have a shape that allows the rotary bezels 80, 280 to rotate in the one direction but does not allow them to rotate in the other direction. In contrast, the rotary bezel may be allowed to rotate both in the one direction and the other direction when the rotary bezel is operated, for example, by shaping the tips of the clicking pieces so as to be bent toward the timepiece rear side.

In addition, the specific number, shape, and other factors of each of the recesses and protrusions of the clicking engagement sections, the cutout openings of the locking engagement sections, the urging pieces, the clicking pieces, the locking pieces, and other components are not limited to those in the embodiments described above and can be determined as appropriate in accordance with an embodiment of the invention.

The entire disclosure of Chinese Patent Application No. 201510088082, filed Feb. 26, 2015 is expressly incorporated by reference herein.

What is claimed is:

1. A timepiece with a rotary bezel comprising:

a case body;

an annular rotary bezel attached to the case body so as to be rotatable relative thereto; and an annular spring member attached to the case body and disposed between the case body and the rotary bezel, wherein the rotary bezel includes clicking engagement sections and locking engagement sections provided along the direction in which the rotary bezel is rotated and is attached to the case body so as to be movable relative thereto in a timepiece thickness direction, and the spring member includes an urging piece that urges the rotary bezel toward a timepiece front side, a clicking piece that engages with and disengages from any of the clicking engagement sections when the rotary bezel is rotated, and a locking piece that engages with any of the locking engagements section when the rotary bezel is moved toward the timepiece front side to prevent the rotary bezel from rotating, whereas disengaging from the locking engagement section when the rotary bezel is moved toward a timepiece rear side to allow the rotary bezel to rotate.

2. The timepiece with a rotary bezel according to claim 1, wherein the rotary bezel includes a bezel body provided with the clicking engagement sections, and an annular fixed member fixed to the bezel body and provided with the locking engagement sections.

3. The timepiece with a rotary bezel according to claim 1, wherein the rotary bezel includes a bezel body, and an annular fixed member fixed to the bezel body and provided with the clicking engagement sections and the locking engagement sections.

4. A timepiece with a rotary bezel comprising:

a case body;

an annular rotary bezel attached to the case body so as to be rotatable relative thereto; and an annular spring member attached to the case body and disposed between the case body and the rotary bezel, wherein the rotary bezel includes engagement sections provided along the direction in which the rotary bezel is rotated and is attached to the case body so as to be movable relative thereto in a timepiece thickness direction, the spring member includes a first spring member fixed to the case body and a second spring member disposed between the first spring member and the rotary bezel and movable in the timepiece thickness direction, the first spring member includes an urging piece that urges the second spring member toward a timepiece front side, and a locking piece that engages with any of the engagement sections when the rotary bezel is moved toward the timepiece front side to prevent the rotary bezel from rotating in one direction, whereas disengaging from the engagement section when the rotary bezel is moved toward a timepiece rear side to allow the rotary bezel to rotate in the one direction, and the second spring member includes a clicking piece that engages with and disengages from any of the engagement sections when the rotary bezel is rotated so that the clicking piece that engages with the engagement section prevents the rotary bezel from rotating in another direction.

5. The timepiece with a rotary bezel according to claim 4, wherein the second spring member is provided with a pressing section that presses the locking piece when the rotary bezel is moved toward the timepiece rear side to cause the locking piece to disengage from the engagement section.

* * * * *